US005793388A

United States Patent [19]

Martinson et al.

[11] Patent Number: 5,793,388

[45] Date of Patent: Aug. 11, 1998

[54] CUSTOMIZED PRINTHEAD SERVICING FOR DIFFERENT PRINTER CONDITIONS

[75] Inventors: Paul E. Martinson, Escondido; Long Doan, San Diego, both of Calif.; Richard A. Becker, Barcelona, Spain; William S. Osborne, Vancouver, Wash.

[73] Assignee: Hewlett-Packard Company, Palo Alto, Calif.

[21] Appl. No.: 399,397

[22] Filed: Mar. 6, 1995

[51] Int. Cl.[6] ..... B41J 29/393

[52] U.S. Cl. ..... 347/19; 347/23

[58] Field of Search ..... 347/19, 14, 22, 347/23, 33

[56] References Cited

FOREIGN PATENT DOCUMENTS

| | | |
|---|---|---|
| 0013095A1 | 7/1980 | European Pat. Off. . |
| 0443832A1 | 8/1991 | European Pat. Off. . |
| 0589581A2 | 3/1994 | European Pat. Off. . |
| 0589581A3 | 3/1994 | European Pat. Off. . |
| 0654352A2 | 5/1995 | European Pat. Off. . |
| 0654352A3 | 5/1995 | European Pat. Off. . |

OTHER PUBLICATIONS

Patent Abstracts of Japan, vol. 16, No. 16 (M-1200), 16 Jan. 1992 & JP-A-03 234648 (Canon, Inc.) 18 Oct. 1991.

Patent Abstracts of Japan, vol. 14, No. 186 (M-962) [4129], 16 Apr. 1990 & JP-A-02 034348 (Canon, Inc.) 5 Feb. 1990.

Patent Abstracts of Japan, vol. 13, No. 528 (M-898) [3876], 24 Nov. 1989 & JP-A-01 216852 (Canon, Inc. ) 30 Aug. 1989.

*Primary Examiner*—Safet Metjahic
*Assistant Examiner*—John Chizmar
*Attorney, Agent, or Firm*—Manuel Quiogue

[57] ABSTRACT

A method for operating an ink jet printer that includes the steps of performing a printer turn-on printhead service on a printhead cartridge of the printer; resetting a page counter, an uncapped condition time counter, and an ink drop counter, wherein the page counter counts the number of pages printed, the uncapped condition time counter counts the amount of time that the printhead cartridge is in the uncapped condition, and the ink drop counter counts the number of ink drops emitted by the printhead cartridge; printing a plurality of pages of print media; after a page is printed performing a post-prime printhead service if the printhead cartridge was primed during the printing of the page; and after a page is printed performing a print time printhead service if the printhead cartridge was not primed during the printing of the page and if (a) the ink jet printer has printed at least a predetermined number of pages since the page count counter was reset, (b) the printhead cartridge has been uncapped for at least a predetermined amount of time since the uncapped condition time counter was reset, or (c) the printhead cartridge has emitted at least a predetermined number of ink drops since the drop counter was reset.

16 Claims, 18 Drawing Sheets

CUSTOMIZED PRINTHEAD SERVICING FOR DIFFERENT PRINTER CONDITIONS

RELATED APPLICATIONS

This application is related to commonly assigned copending application Ser. No. 08/056,326, filed Apr. 30, 1993, by M. T. Dangelo for "MANUAL PEN SELECTION FOR CLEARING NOZZLES WITHOUT REMOVAL FROM PEN CARRIAGE"; commonly assigned copending application Ser. No. 08/225,039, filed Apr. 8, 1994, by W. H. Schwiebert and G. G. Firl for "WIPING SYSTEM FOR INKJET PRINTER"; commonly assigned copending application Ser. No. 08/330,461, filed Oct. 28, 1994, by W. S. Osborne, B. Taylor, and P. J. Therien for "ORTHOGONAL ROTARY WIPING SYSTEM FOR INKJET PRINTHEADS"; commonly assigned copending application Ser. No. 08/398,720, filed Mar. 6, 1995, by D. C. Burney et. al. for "ACTUATION MECHANISM FOR TRANSLATIONAL WIPING OF A STATIONARY INKJET PRINTHEAD," commonly assigned copending application Ser. No. 08/398,709, filed Mar. 6, 1995, by R. A. Becker et al. for "TRANSLATIONAL WIPING TECHNIQUE FOR A STATIONARY INKJET PRINTHEAD," and commonly assigned copending application Ser. No. 08/399,380, filed Mar. 6, 1995, by R. A. Becker et al. for "INDEPENDENT WIPING/SPITTING STATION FOR INKJET PRINTHEAD," all incorporated herein by reference.

BACKGROUND OF THE INVENTION

The disclosed invention is generally directed to servicing of thermal ink jet printheads, and more particularly to printhead servicing wherein different printhead service procedures are performed for different printer conditions.

An ink-jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink-jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

In order to maintain quality of print output, thermal ink jet printers require recurrent maintenance service of the printheads of a thermal ink jet printer to optimally maintain properly functioning printheads which are subjected to ink, paper dust, and environmental factors. A consideration with the requirement for recurrent printhead maintenance is that performance of printhead maintenance more frequently than necessary can be detrimental to the printhead reliability. However, printhead maintenance that is not performed sufficiently frequently results in degraded print quality and the possibility of user intervention which could reduce printhead reliability. Also, performing the same printhead maintenance service for different printer conditions that requires a printhead service can be detrimental to printhead reliability.

SUMMARY OF THE INVENTION

It would therefore be an advantage to provide a printhead maintenance service procedure that performs different printhead service procedures for different printer conditions.

Another advantage would be to provide to provide printhead maintenance service procedures that avoid excessive printhead wiping.

The foregoing and other advantages are provided by the invention in a method of servicing an ink jet printhead cartridge that includes the steps of performing a printer turn-on printhead service on a printhead cartridge of the printer; resetting a page counter, an uncapped condition time counter, and an ink drop counter, wherein the page counter counts the number of pages printed, the uncapped condition time counter counts the amount of time that the printhead cartridge is in the uncapped condition, and the ink drop counter counts the number of ink drops emitted by the printhead cartridge; printing a plurality of pages of print media; after a page is printed performing a post-prime printhead service if the printhead cartridge was primed during the printing of the page; and after a page is printed performing a print time printhead service if the printhead cartridge was not primed during the printing of the page and if (a) the ink jet printer has printed at least a predetermined number of pages since the page count counter was reset, (b) the printhead cartridge has been uncapped for at least a predetermined amount of time since the uncapped condition time counter was reset, or (c) the printhead cartridge has emitted at least a predetermined number of ink drops since the drop counter was reset.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
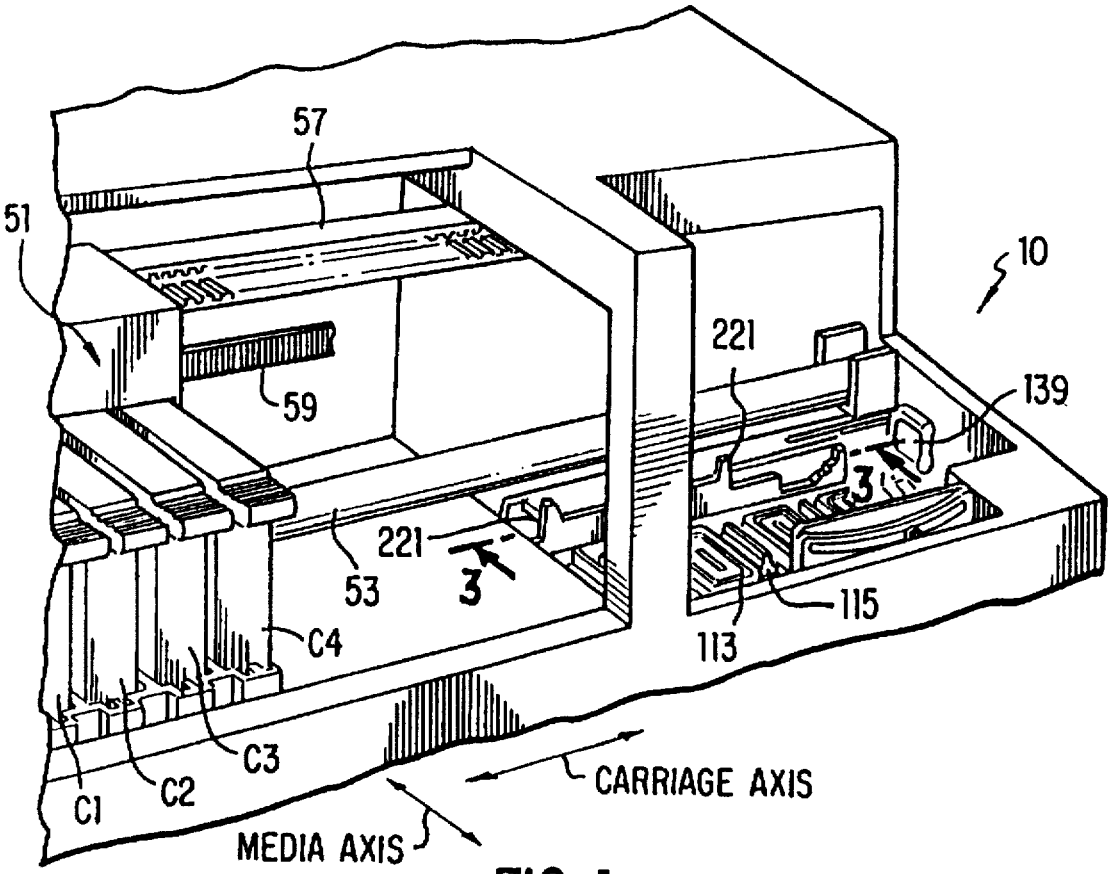
FIG. 1 is a schematic perspective view of the major mechanical components of a thermal ink jet printer that includes primer apparatus in accordance with the invention.

In the following detailed description and in the several figures of the drawing, like elements are identified with like reference numerals.

Referring now to FIG. 1, set forth therein is a schematic frontal quarter perspective view depicting, by way of illustrative example, major mechanical components of a multiple printhead ink jet printer in which the techniques of the invention can be implemented. The printer includes a movable carriage 51 mounted on a guide rail 53 for translational movement along the carriage scan axis. The carriage 51 is driven along the guide rail 53 by an endless belt 57 which can be driven in a conventional manner, and a linear encoder strip 59 is utilized to detect position of the carriage 51 along the carriage scan axis, for example in accordance with conventional techniques.

The carriage 51 removably retains four printhead cartridges C1, C2, C3, C4 (sometimes called "pens," "print cartridges," or "cartridges") which are side by side along the carriage axis. Each of the cartridges C1, C2, C3, C4 includes a nozzle array comprised of a plurality of downwardly facing nozzle arrays for ejecting ink generally downwardly to a print media which is supported in an appropriate manner below the path traversed by printhead cartridges when the carriage 51 is scanned along the carriage axis. The print media is moved along a print media advance axis which is parallel to the print media surface that is below the nozzles of the printhead cartridges orthogonal to the carriage scan axis. In accordance with conventional thermal ink jet printhead architecture, ink drops are fired from the nozzles pursuant to ink firing pulses applied to heater resistors respectively associated with the nozzles and located in the printhead interiorly of the nozzles.

By way of illustrative example, the cartridges C1, C2, C3 comprise non-black color printing cartridges for producing the base colors of yellow, cyan, and magenta as commonly utilized in color printing, while the cartridge C4 comprises a black printing cartridge. The black printing cartridge C4 is more particularly the most outboard of the group of cartridges (i.e., the rightmost cartridge as viewed in FIG. 1).

The printer of FIG. 1 further includes a first service station located to one side of the media print area and generally indicated by the reference numeral 10. The first service station functions to cap the nozzle arrays of the printhead cartridges, and wipe the nozzle arrays. The station more particularly includes a movable sled 111 that includes respective caps 113 configured to cap respective nozzle arrays of the cartridges when the carriage is moved into position over the caps 113. In particular, the caps 113 are designed to a surround the printhead nozzle arrays rather than contact them, so as to reduce drying of ink. The caps 113 further function to convey priming vacuum to the nozzle arrays of the printhead cartridges. The movable sled 111 also includes resilient wipers 115 for wiping the nozzle arrays of the leftmost three printhead cartridges C1, C2, C3, as described more fully herein.

Figure 2:
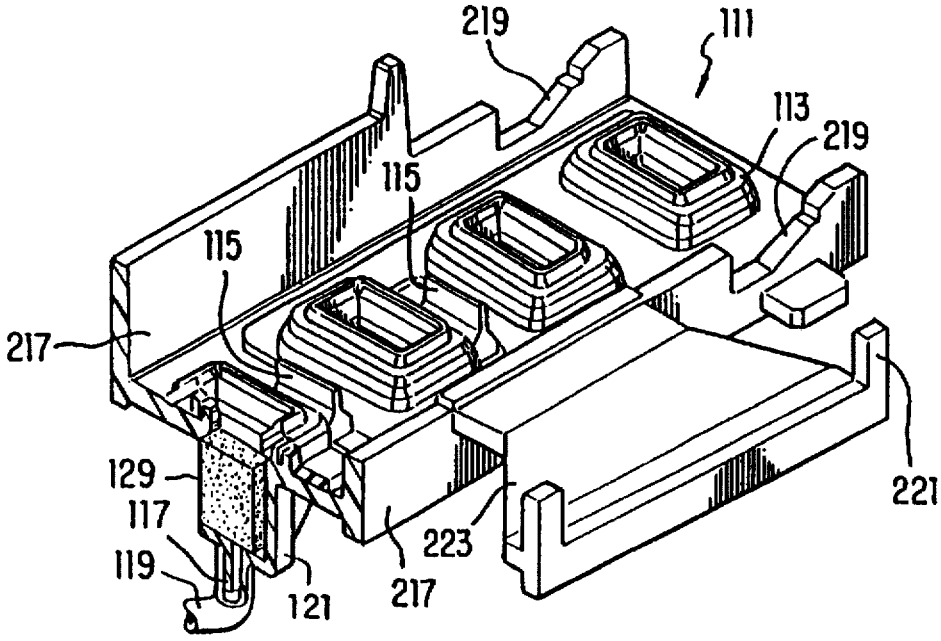
FIG. 2 is a schematic perspective view of a sled of a first service station of the printer of FIG. 1.

As shown in FIG. 2, the movable sled 111 further includes vertical side panels 217 in front of and behind the caps 113, and cam surfaces 219 are formed in the side panels generally adjacent the distal caps. The cam surfaces 219 are mirror images of each other across a vertical plane that is parallel to the carriage axis. The sled also includes two vertically extending cam follower prongs 221 that are formed on the front side panel between the cam surfaces 219, and two vertically extending cam follower prongs 221 on a forwardly extending panel 223. The cam following prongs 221 are mirror images of each other across a vertical plane that is parallel to the carriage axis. As shown more fully in FIGS. 17–22, vertical and horizontal movement of the sled 111 is controlled by engagement of the vertical prongs 221 by cam surfaces 233 and slots 231 in the carriage 51 and by the upward engagement of the cam surfaces 219 against stationary guide pegs 237 pursuant to upwardly biasing springs 235. In particular, the cam surfaces 219 and the vertical prongs 221 of the sled, stationary guide pegs 237 engaged with the cam surfaces 219, and the cam surfaces 233 and slots 231 of the carriage 51 that engage the vertical prongs 221 are configured such that the sled 111 is in its vertically highest position, called the capping position, when it is furthest from the print media (i.e., towards the right side of the printer), and is in its vertically lowest position, called the down position, when it is closest to the print media region (i.e., towards the center of the printer). In the capped position, the caps 113 of the sled 111 are in engagement with the nozzle arrays of the printhead cartridges, while in the down position the caps 113 and the wipers 115 are away from the path of the nozzle arrays. The carriage 51 and the sled 111 are configured such that wiping only takes place when the carriage moves to left after positioning the sled in the capping position pursuant to movement of the carriage to the right.

As shown in FIG. 2 for one of the caps 113, each cap 113 is secured to the top opening of a chamber 121 that extends downwardly and includes a lower port 117 that is connected to one end of a flexible tube 119 whose other end is connected to a source of priming vacuum (not shown) which is selectively controlled to apply priming vacuum to the flexible tube 119. Each chamber 121 of the movable sled 111 can contain a filter 129 for trapping ink to prevent ink from entering and clogging the flexible tube 119.

Figure 3:
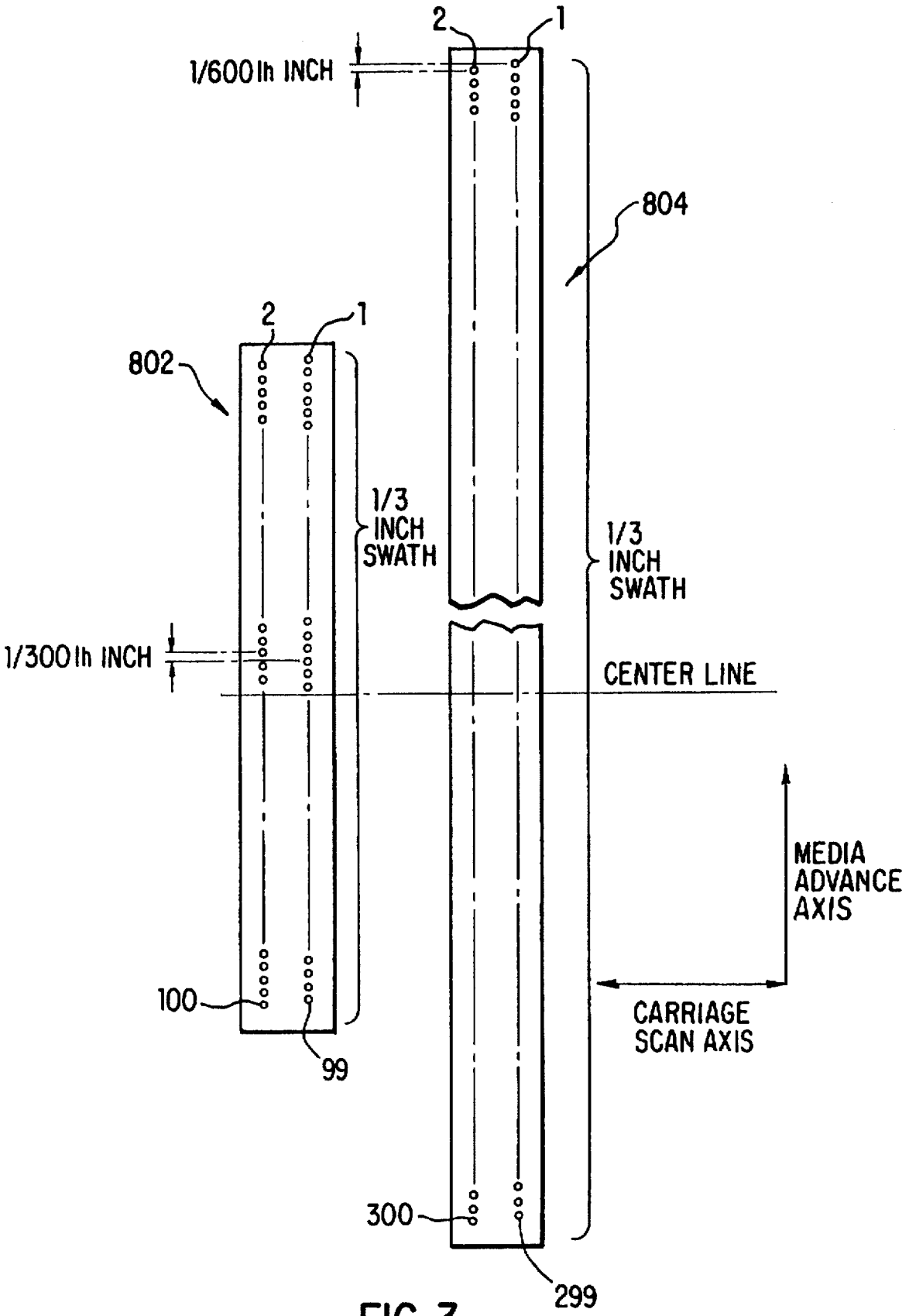
FIG. 3 schematically shows the nozzle arrays for a narrow swath 300 dpi non-black printing printhead and a wide swath 600 dpi black printing printhead, respectively, which can be serviced by the techniques of the invention.

Each nozzle array of the cartridges C1, C2, C3, C4 includes an even number of nozzles arranged in two columns which are parallel to the media advance axis, wherein the nozzle columns are staggered relative to each other, as schematically depicted in FIG. 3 for nozzle arrays 802 and 804 of the cartridges C3, C4 as viewed from above the nozzles of the cartridges (i.e., the print media would be below the plane of the figure). The distance along the media scan axis between diagonally adjacent nozzles of each nozzle array is known as the nozzle pitch, and by way of example is equal to the resolution dot pitch of the desired dot row resolution (e.g., 1/300 inch for 300 dpi). In use, the physical spacing between the columns of nozzles in a printhead cartridge is compensated by appropriate data shifts in the swath print data so that the two columns function as a single column of nozzles. By way of particular illustrative example, each of the non-black printing printhead cartridges C1, C2, C3 has 100 nozzles and a print resolution of 300 dpi (i.e., a dot pitch of 1/300 inch), while the black printing printhead cartridge C4 has 300 nozzles and a print resolution of 600 dpi (i.e., a dot pitch of 1/600 inch).

Figure 4:
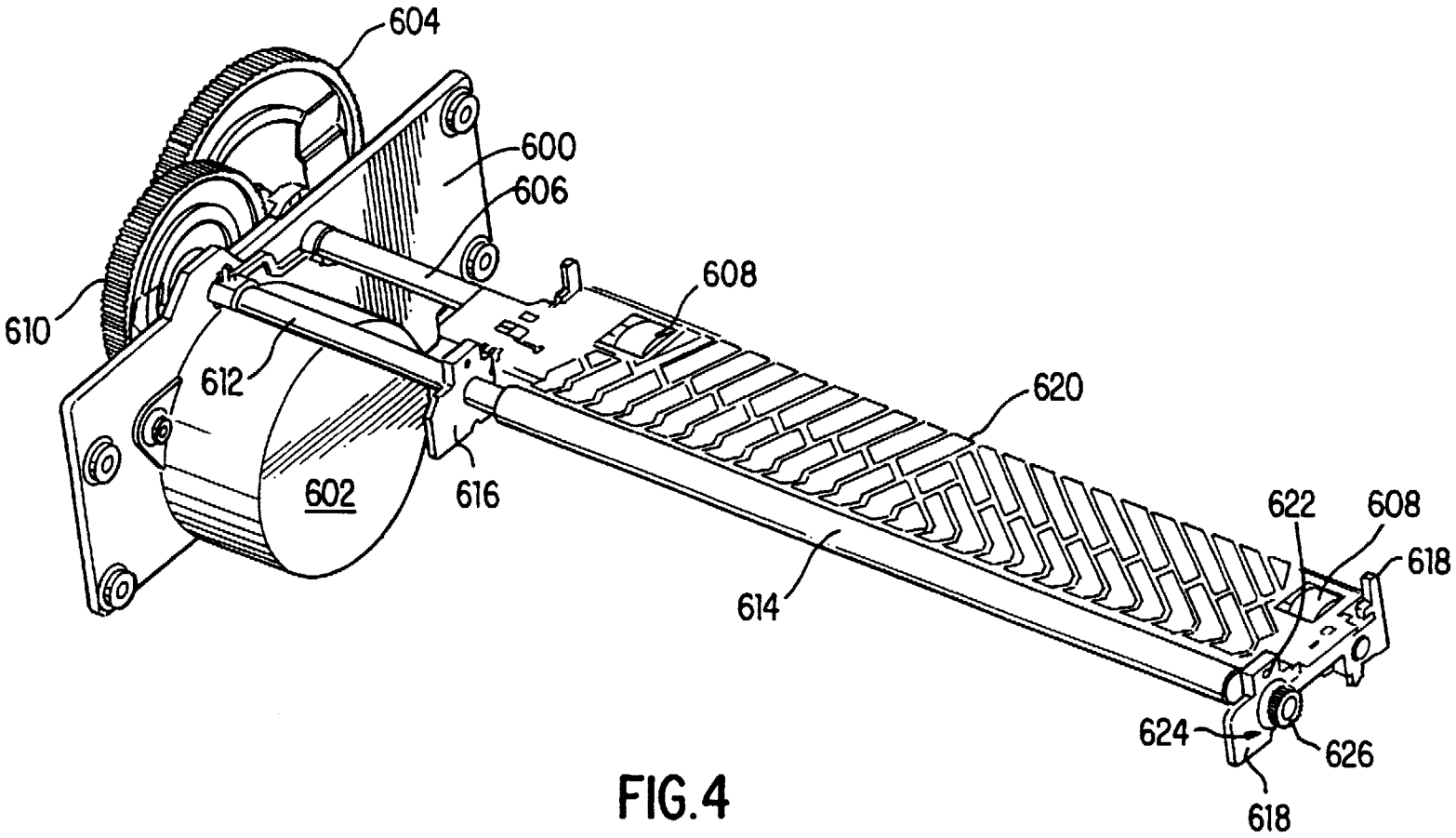
FIG. 4 is a perspective view showing a media advance drive roller system with a drive gear mounted on one end of a media advance drive axle for driving a wiper unit of second service station of the printer.
Figure 5:
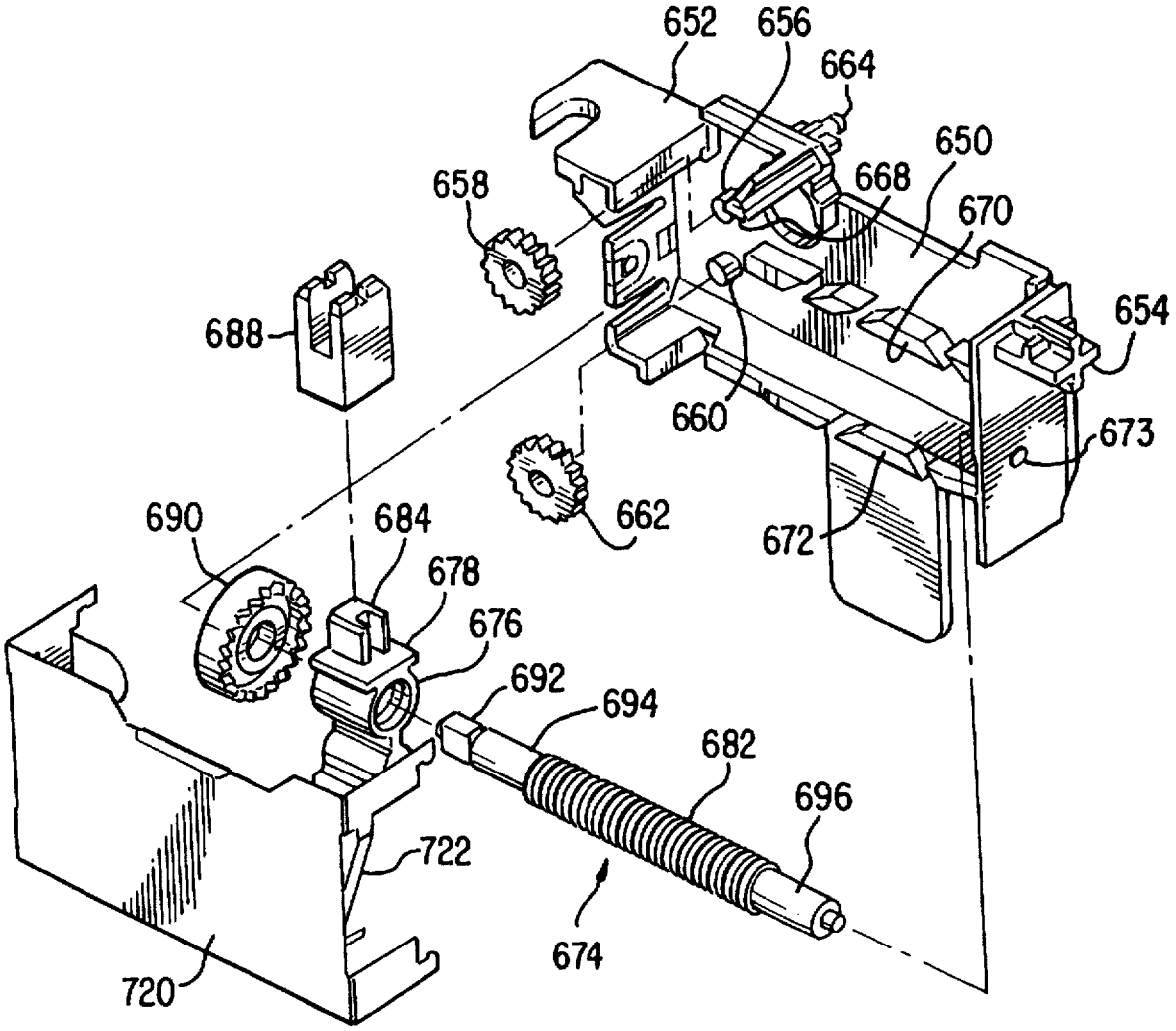
FIG. 5 is an exploded view of the second service station of the printer of FIG. 1.
Figure 6:
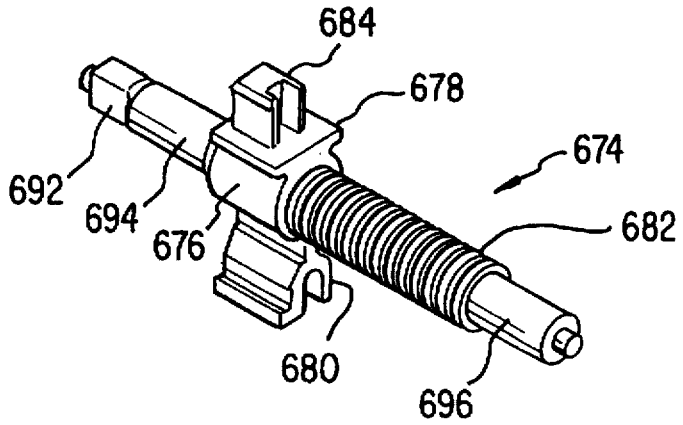
FIG. 6 shows a wiper base on a leadscrew of the second service station.
Figure 7:
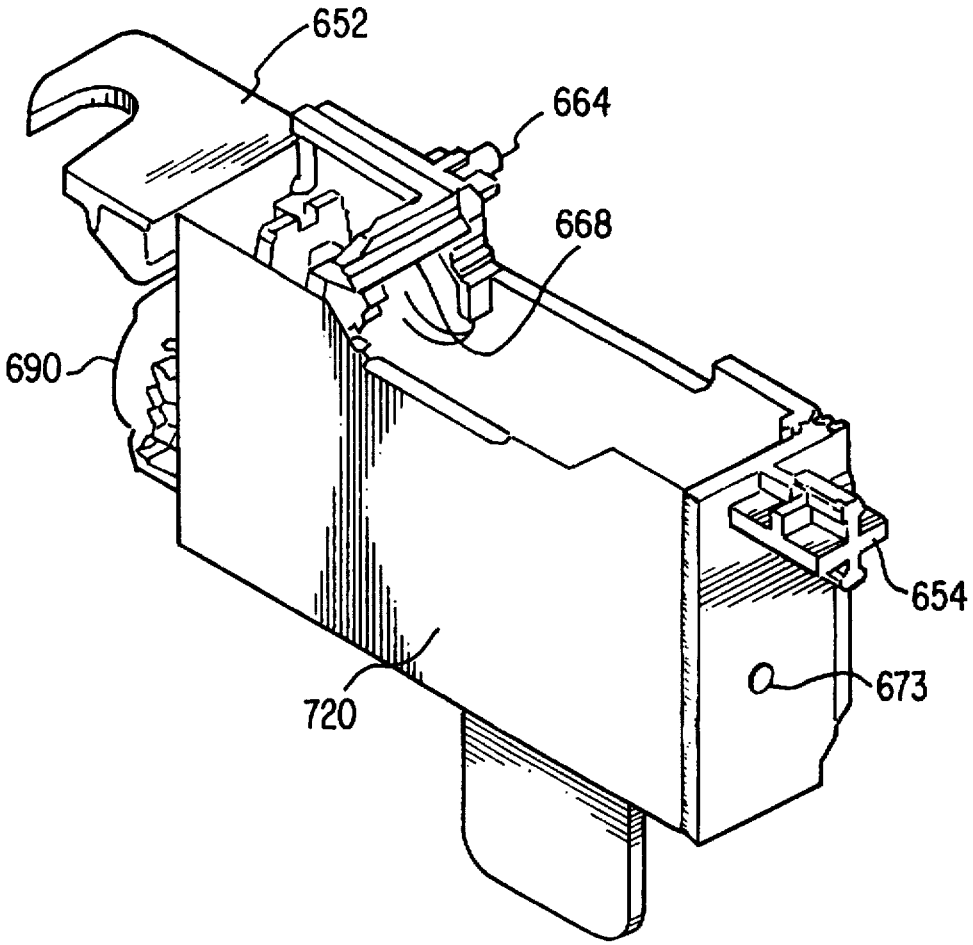
FIG. 7 is a perspective view of the second service station ready for installation in the printer, with a wiper unit in a parked position.
Figure 8:
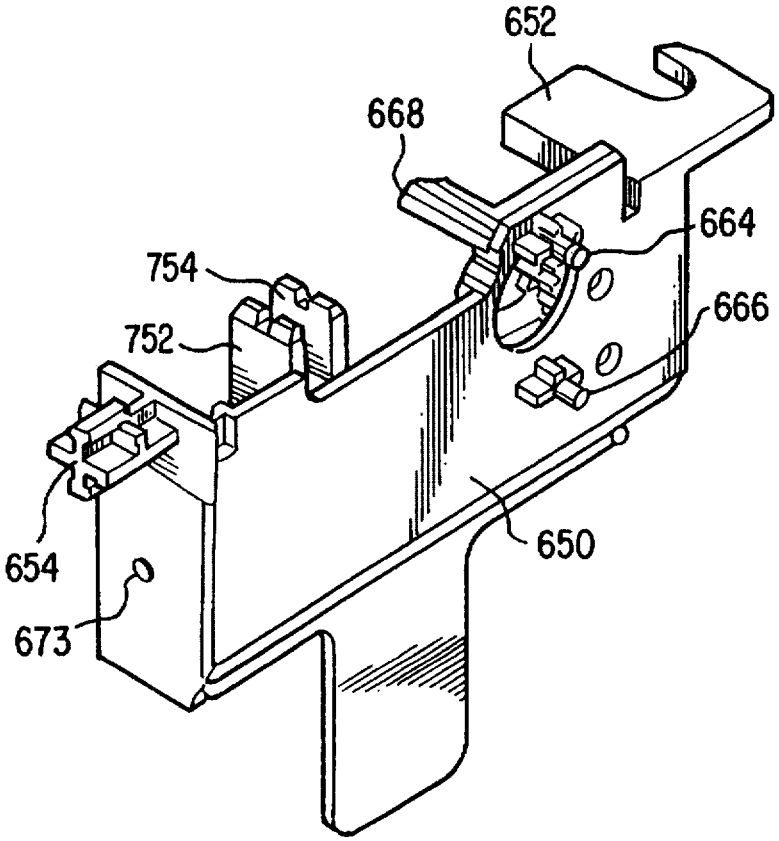
FIG. 8 is a perspective view of a housing portion of the second service station.

Referring now to FIG. 4, schematically illustrated therein is a drive assembly that utilizes a media advance motor for driving a wiper unit of a second service station that is installed inboard the service station 10, and is utilized to wipe the nozzle array of the black printing printhead cartridge C4, wherein wiper blades are moved across the nozzle array of the black printing printhead cartridge in a direction that is parallel to the media advance axis and thus along the nozzle columns of the nozzle array of the black printing printhead cartridge C4. The second service station also functions as a spittoon for receiving ink drops emitted by a printhead cartridge pursuant to a spitting operation.

The perspective view of FIG. 4 shows how a second service station can be driven by a media advance motor, and also shows how a wiper unit in the second service station is mounted relative to the print zone generally and to the printer platen specifically. In that regard, the media advance system for an inkjet printer with a heated print zone such as the Hewlett-Packard Deskjet 1200C inkjet printer includes a vertical support plate 600, a stepper motor 602, a main driver gear 604 which drives a first axle 606 carrying primary drivewheels 608, a secondary drive gear 610 which drives a second axle 612 carrying secondary driveroller 614. Left and right using plates 616, 618 provide precise positioning of the drivewheels 608 and the driveroller 614 closely adjacent to a screen platen 620 which supports media passing through a heated print zone.

The right bushing plate 618 is modified to provide precise positioning of a second service station unit which is located next to the right bushing plate. The right bushing plate includes a top hole 622 and a bottom hole 624 for positional mounting of the second service station unit. A service station drive gear 626 is fixedly mounted on the right end of second axle 612.

The structural details of the second service station unit are best shown in FIGS. 5–8. A housing 650 includes a front mounting tab 652, back mounting 654, top bearing pin 656 for rotatably mounting top spur gear 658, bottom bearing pin 660 for rotatably mounting bottom spur gear 662, externally projecting top and bottom mounting pins 664, 666, scraper 668, upper and lower cam surfaces 670, 672, and forward and rear bearing holes for rotatably mounting a leadscrew 674.

A nut member is provided to form a wiper base 676 which has upper and lower cam followers 678, 680 which respectively track upper and lower cam surfaces 670, 672 as the wiper base moves in back-and-forth linear motion along a central threaded portion 682 of the leadscrew 674. An upwardly projecting key shaft 684 on the wiper base 676 is shaped to engage a matching interior mounting channel 686 of a removable wiper blade 688.

A face gear 690 is mounted on a square hub 692 of the leadscrew 674 as the last element in a gear train to rotatably drive the leadscrew. The leadscrew 674 includes unthreaded front and back portion 694, 696 to provide temporary parking positions for the wiper base after it has traversed along the central threaded portion 682 during rotation of the leadscrew by the face gear.

A cover 720 is sized and shaped to fit together with the housing 650 to form a spittoon in the second service station. The cover includes a front spring arm (not shown) and a back spring arm 722 to urge the wiper base into engagement with the central threaded portion 682 during appropriate time periods of the wiping procedure.

Figure 9A:
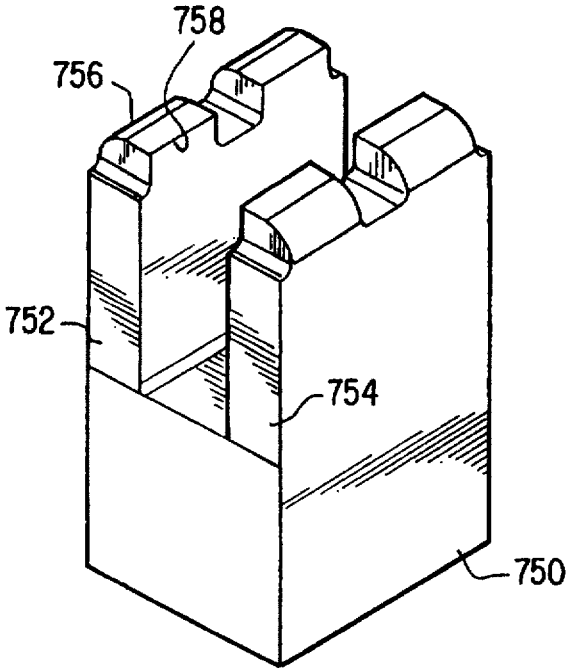
FIGS. 9A and 9B are enlarged perspective top and bottom views, respectively, of a wiper blade component of the second service station.
Figure 9B:
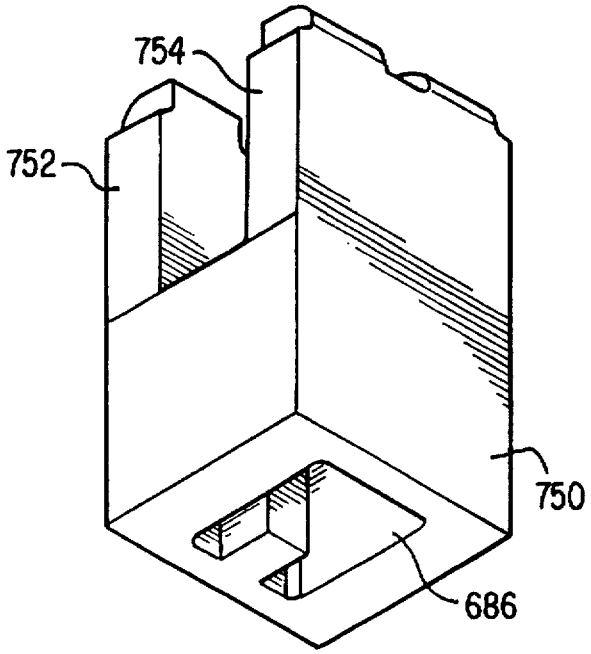
Figure 10:
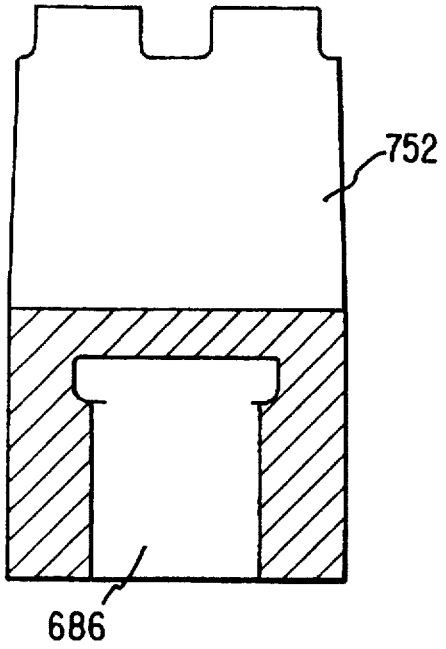
FIG. 10 is a partially sectional view showing an interior mounting channel of the wiper blade component of FIGS. 9A and 9B.

As shown in FIGS. 9A–9B and 10 a wiper blade member 750 made with an elastomer material such as EPDM includes successive wiper blades 752, 754 which are split to form separate spaced apart wiping sections. Each section presents a rounded edge 756 and a sharp edge 758 to sequentially wick ink from orifices onto a nozzle surface of the printhead with the rounded wiper edge and immediately thereafter remove ink from the nozzle surface of the printhead with the sharp wiper edge. Such split configuration is particularly designed for use with inkjet nozzle arrays having two columns of ink orifices, such as a ⅓ inch swath printhead 802 with one hundred nozzles in a 300 dpi array and/or a ½ inch swath printhead 804 with three hundred nozzles in a 600 dpi array (see FIG. 3).

Figure 11A:
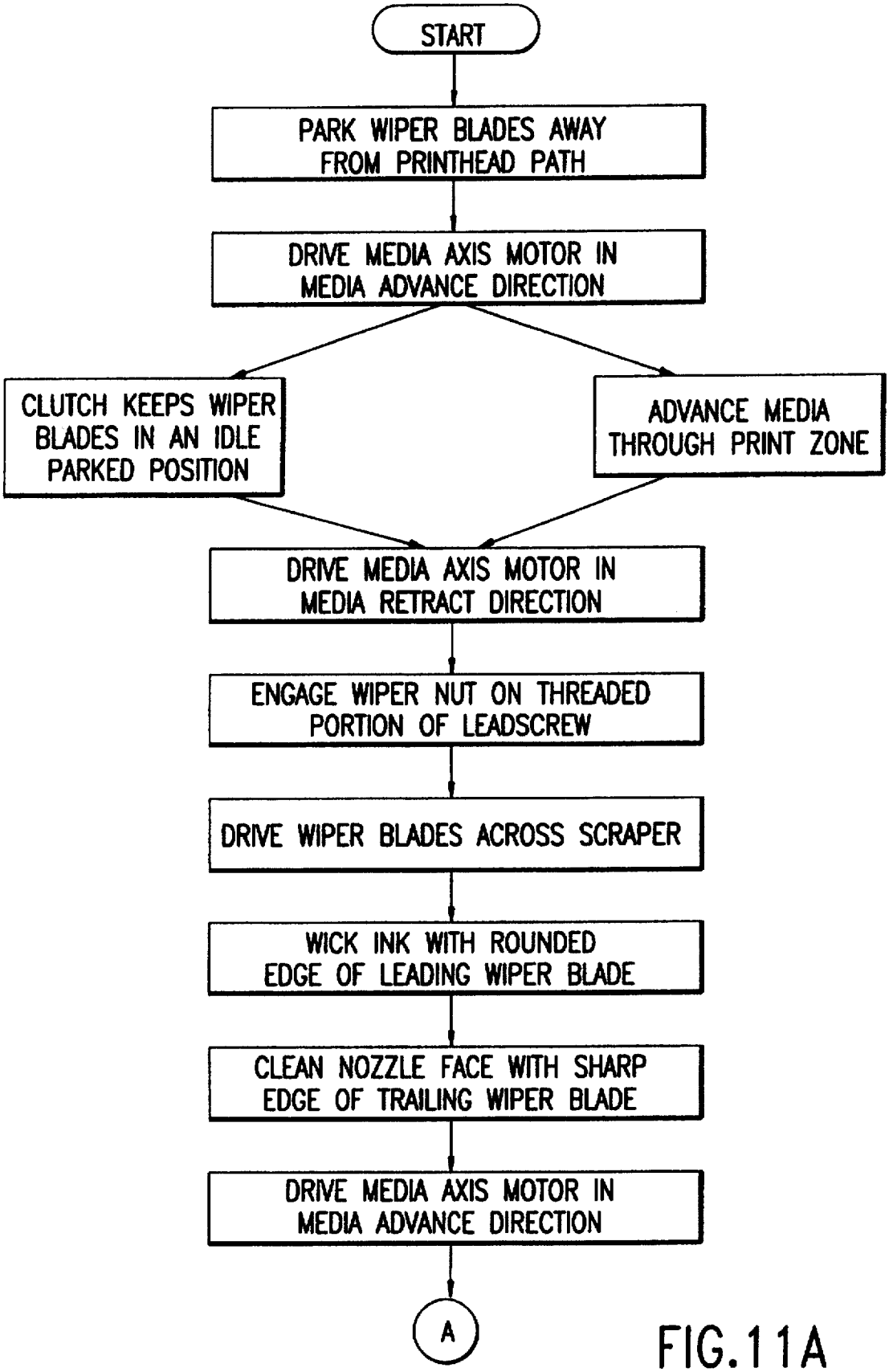
FIGS. 11A and 11B set forth a flow diagram of the operation of the second service station.
Figure 11B:
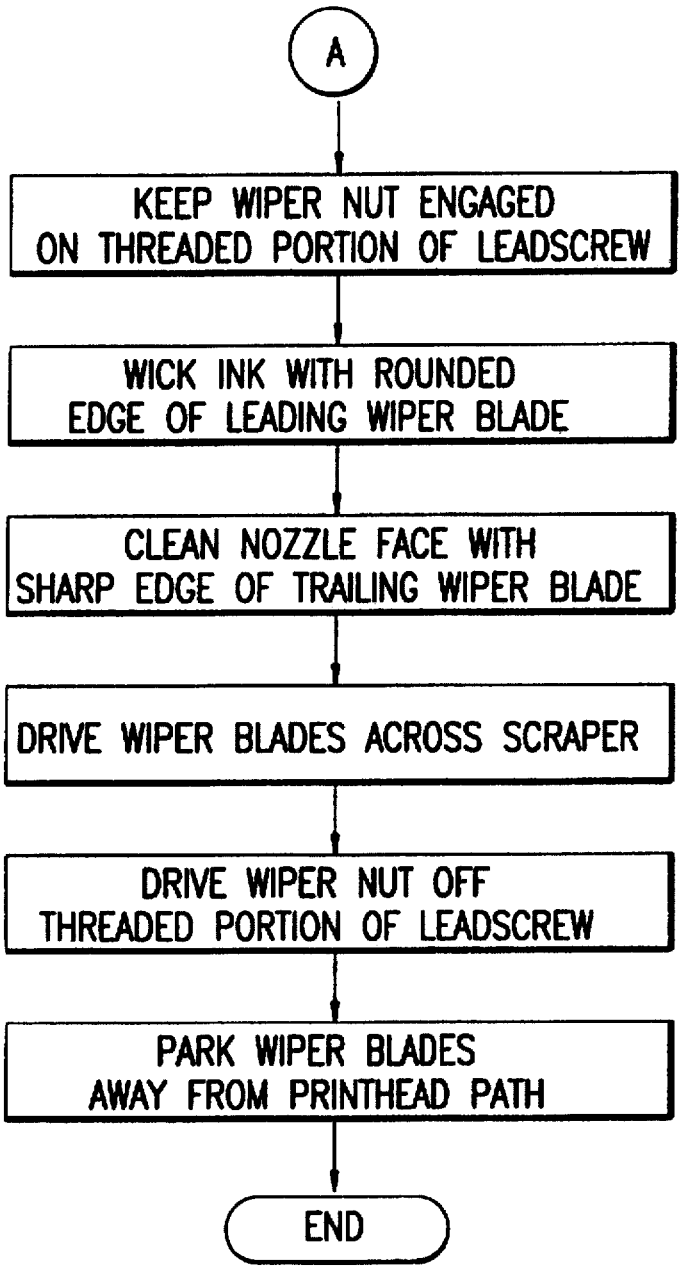

The aforementioned structure of the second service station provides for the unique wiping/scraping procedure as set forth in the flow diagram of FIGS. 11A–11B. It will be understood from the self-explanatory flow chart that initially the wiper blades are parked in an idle position with the wiper base in a home position on the unthreaded portion of the leadscrew, even through the leadscrew continues to rotate during a printing operation. After the printing operation is completed and the media is advanced out of the print zone, the stepper motor is reversed to activate the second service station. As the threads of the leadscrew engage the wiper nut, the flexible wiper blade edges are first driven across the rigid scraper to clean them in order to avoid damaging the nozzle surface, and then are driven across the ink orifices for wicking and cleaning actions. The cycle is completed by reversing the stepper motor to again accomplish wicking and cleaning actions followed by the step of scraping the flexible wiper blade edges. The threaded wiper base then moves into an idle or parked position due to the clutch action of the unthreaded portion of the leadscrew.

Figure 12:
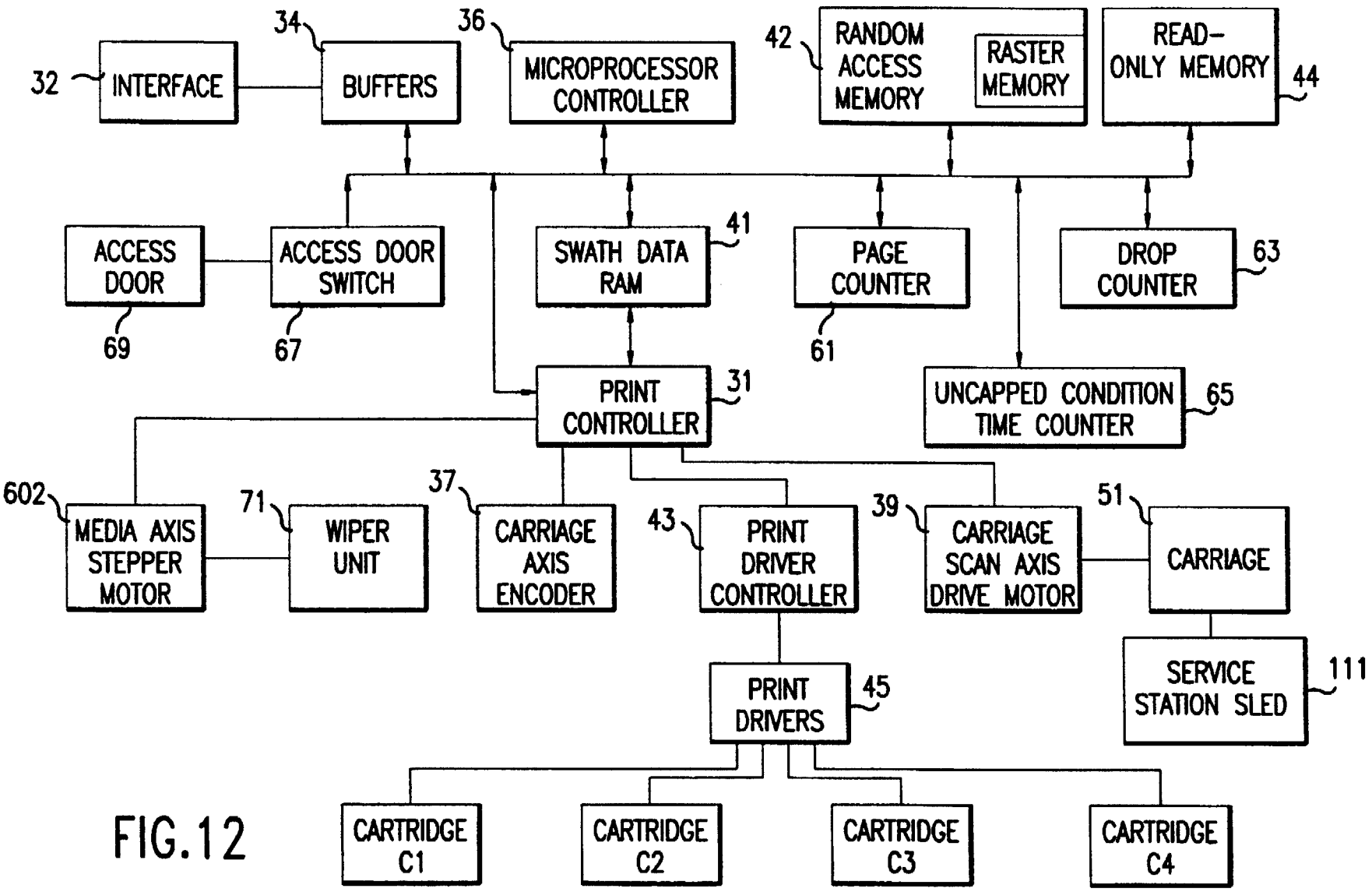
FIG. 12 is a simplified block diagram of a printer control system for controlling the swath printer of FIG. 1.

Referring now to FIG. 12, set forth therein is a simplified block diagram of a control system for controlling the thermal ink-jet printer of FIG. 1 in which the techniques of the invention can be implemented. The control system includes an interface 32 which receives print data from a host computer, for example, and stores the print data in a buffer memory 34. A microprocessor controller 36 is configured to process the print data to produce raster data that is stored in a bit-map memory 42a contained in a random access memory (RAM) 42 provided for the use of the microprocessor controller. A read-only memory 44 is also provided as appropriate for the use of the microprocessor controller 36.

A print controller 31 transfers portions of the raster data from the bit-map memory 42a to a swath memory 41 and provides swath data to a printhead driver controller 43 which controls printhead drivers 45 that drive the ink firing heater resistors of the printhead cartridges C1, C2, C3, C4. The print controller 31 further controls the media axis stepper motor 602 which drives media movement rollers and a wiper unit 71 pursuant to media motion commands from the print controller 31. The wiper unit 71 is comprised of the second service station components that achieve the back and forth wiping as described above relative to FIGS. 4–8, 9A–9B, 10, and 11A–11B. A carriage axis encoder 37 provides feedback information for the feedback control of a carriage scan axis drive motor 39 which positions the inkjet cartridge supporting carriage 51 pursuant to carriage motion commands from the print controller 31. Appropriate movements of the carriage 51 actuates the sled 111 of the first service station 10.

The control system of FIG. 12 further includes a page counter 61, an uncapped condition time counter 63, and a drop counter 65 for counting the number of pages printed, the amount of time that the printhead cartridges are in the uncapped condition, and the number of drops emitted by the black printing printhead cartridge. A page of print media comprises for example a sheet of standard size paper such as a letter size sheet, a legal size sheet, or a metric A4 size sheet. While shown as separate blocks, the counters can be implemented in accordance with conventional techniques as memory locations in RAM that are regularly updated by the microprocessor controller 36. By way of illustrative example, the drop counter is updated by the microprocessor pursuant to drop information provided by the print controller, wherein the drop information is representative of the number of ink firing pulses provided to the black printing printhead cartridge. In accordance with conventional printer implementations, the controller of FIG. 12 also includes an access door switch 67 for detecting whether an access door 69 of the printer of FIG. 1 is in the open or closed state, wherein the access door allows user access to the printhead cartridges, for example.

Figure 13A:
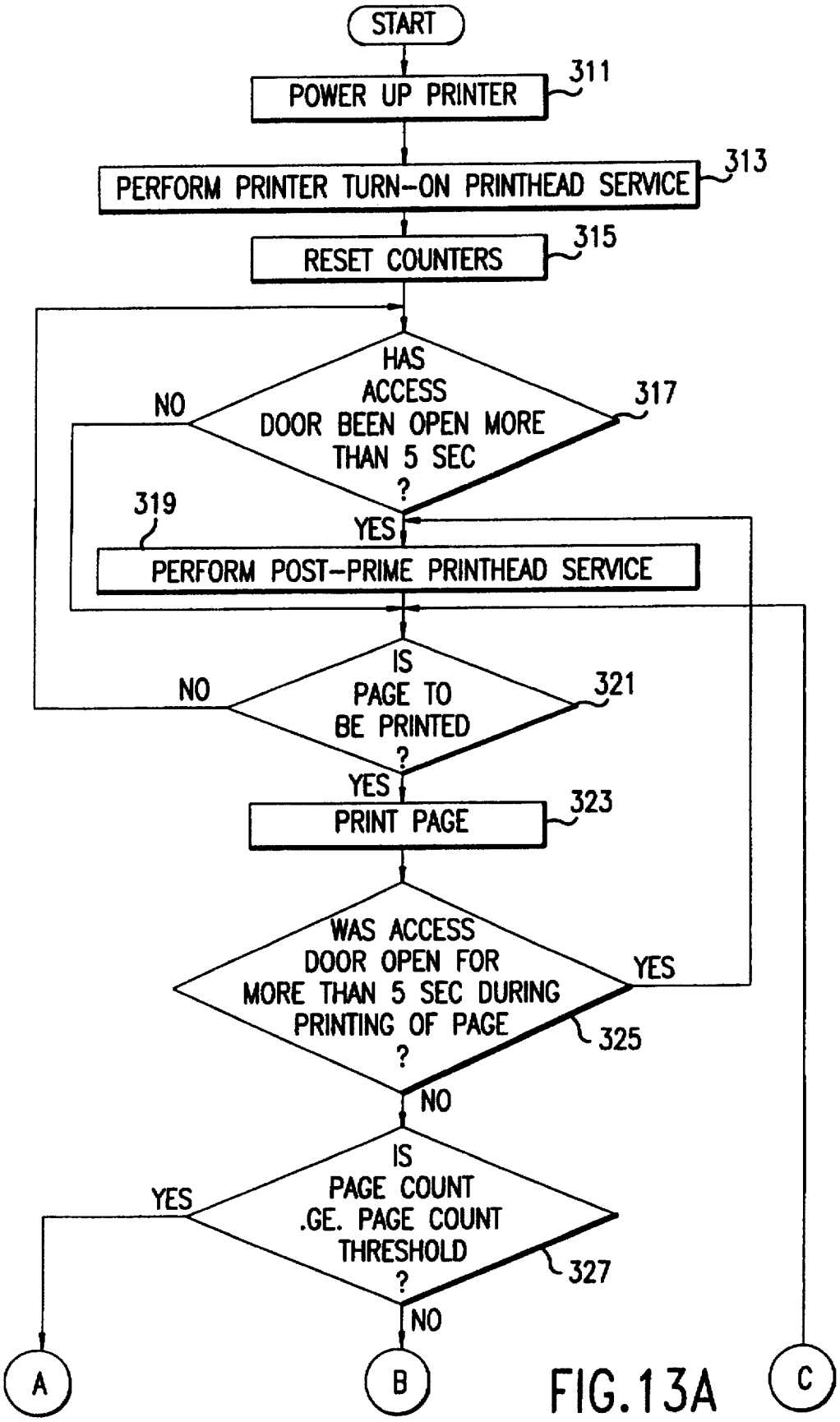
FIGS. 13A and 13B set forth a flow diagram of a printhead service procedure in accordance with the invention.
Figure 13B:
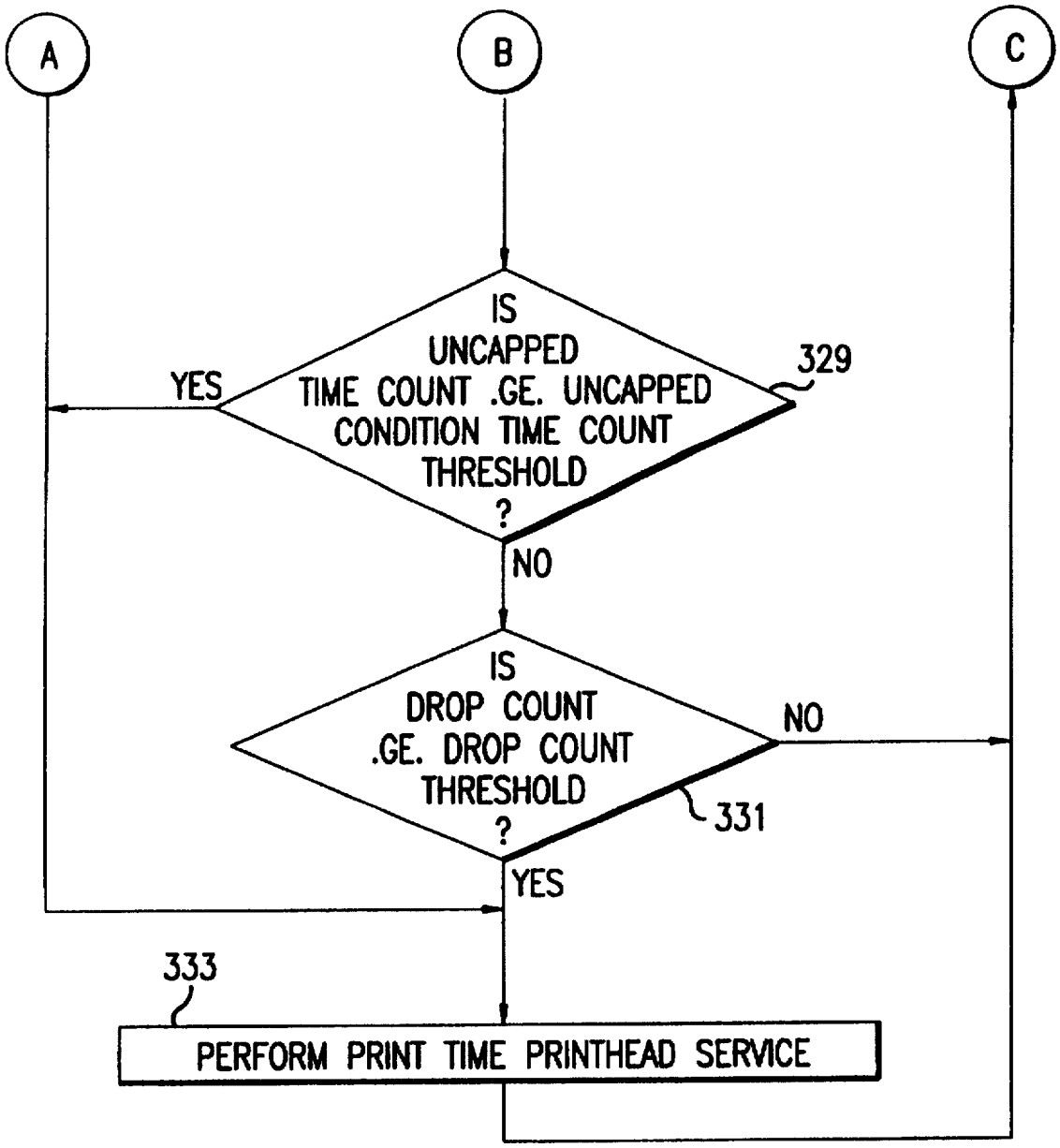

Referring now to FIGS. 13A and 13B, set forth therein a flow diagram of a procedure for servicing the printhead cartridges of the printer of FIG. 1. At 311 the printer is powered up, and at 313 a printer turn-on printhead service is performed, as more particularly shown in FIG. 14. At 315 the page counter, the upcapped condition time counter, and the drop counter are reset to 0. At 317 a determination is made as to whether the access door has been in the open state for more than 5 seconds. If the determination at 317 is yes, at 319 a post-prime printhead service is performed, as more particularly shown in FIG. 15. The post-prime service is performed since the condition of the access door having been open for more than 5 seconds indicates that a user may have primed one or more of the printhead cartridges. It should be appreciated that other conditions can be detected to determine whether priming has occurred. After the post-prime printhead service is performed, at 321 a determination is made as to whether a page of print media is to be printed. If no, control transfers to 317. If the determination at 317 is no, control transfers to the determination at 321.

Figure 15:
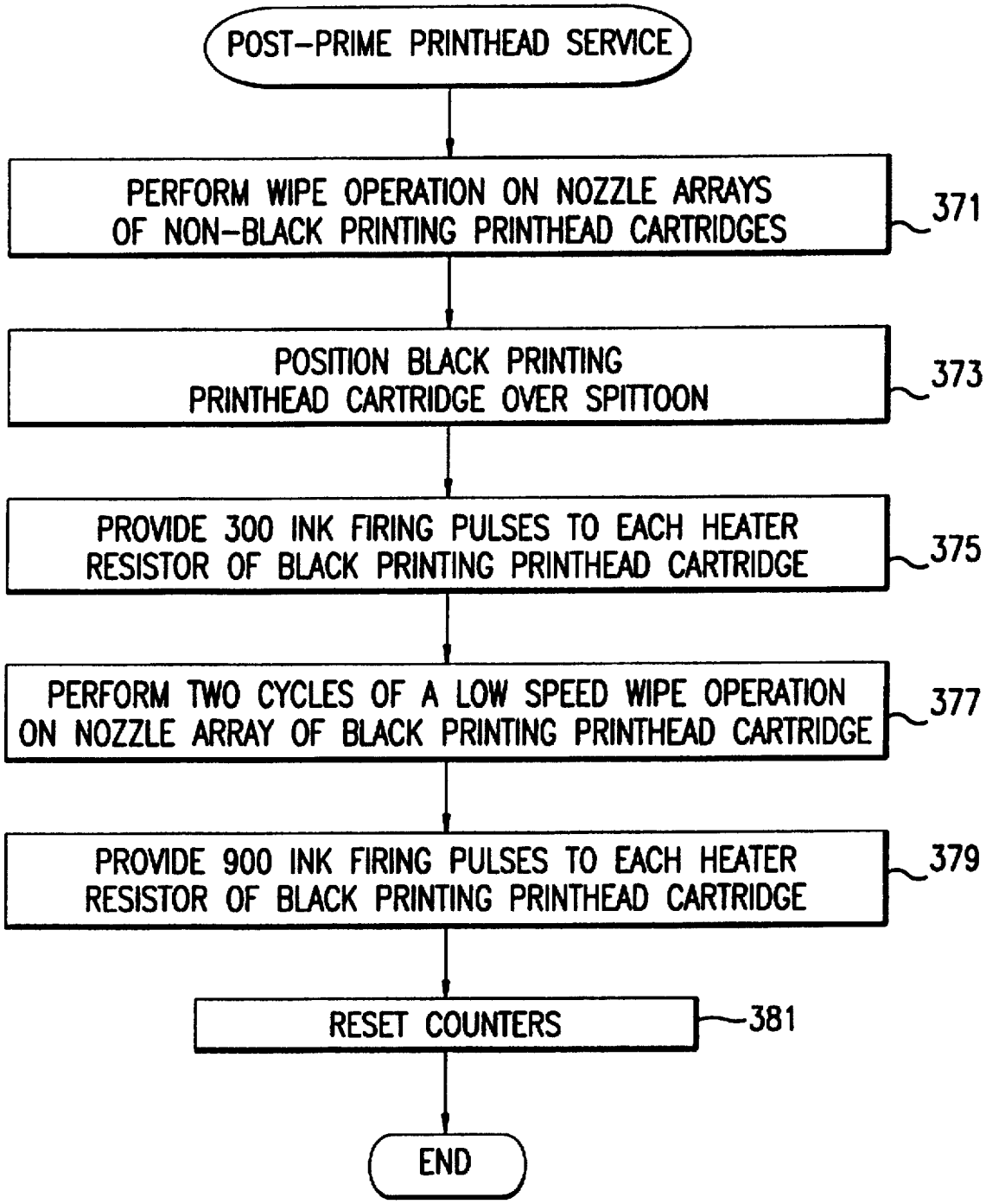
FIG. 15 is a flow diagram illustrating a post-prime printhead cartridge service of the printhead service procedure of FIGS. 13A and 13B.

If the determination at 321 is yes, a page needs to be printed, at 323 a page is printed. At 325 a determination is made as to whether the access door had been in the open condition for more than 5 seconds while a page was being printed at 323. If yes, control transfers to 319 and the post prime printhead service of FIG. 15 is performed. After the post prime printhead service is performed, control transfers to 321.

If the determination at 325 is no, at 327 a determination is made as to whether the page count is greater than or equal to a predetermined page count threshold, such as 30 pages. If yes, at 333 a print time printhead service is performed as more particularly illustrated in FIG. 16. After the print time printhead service is performed, control transfers to 321.

Figure 16:
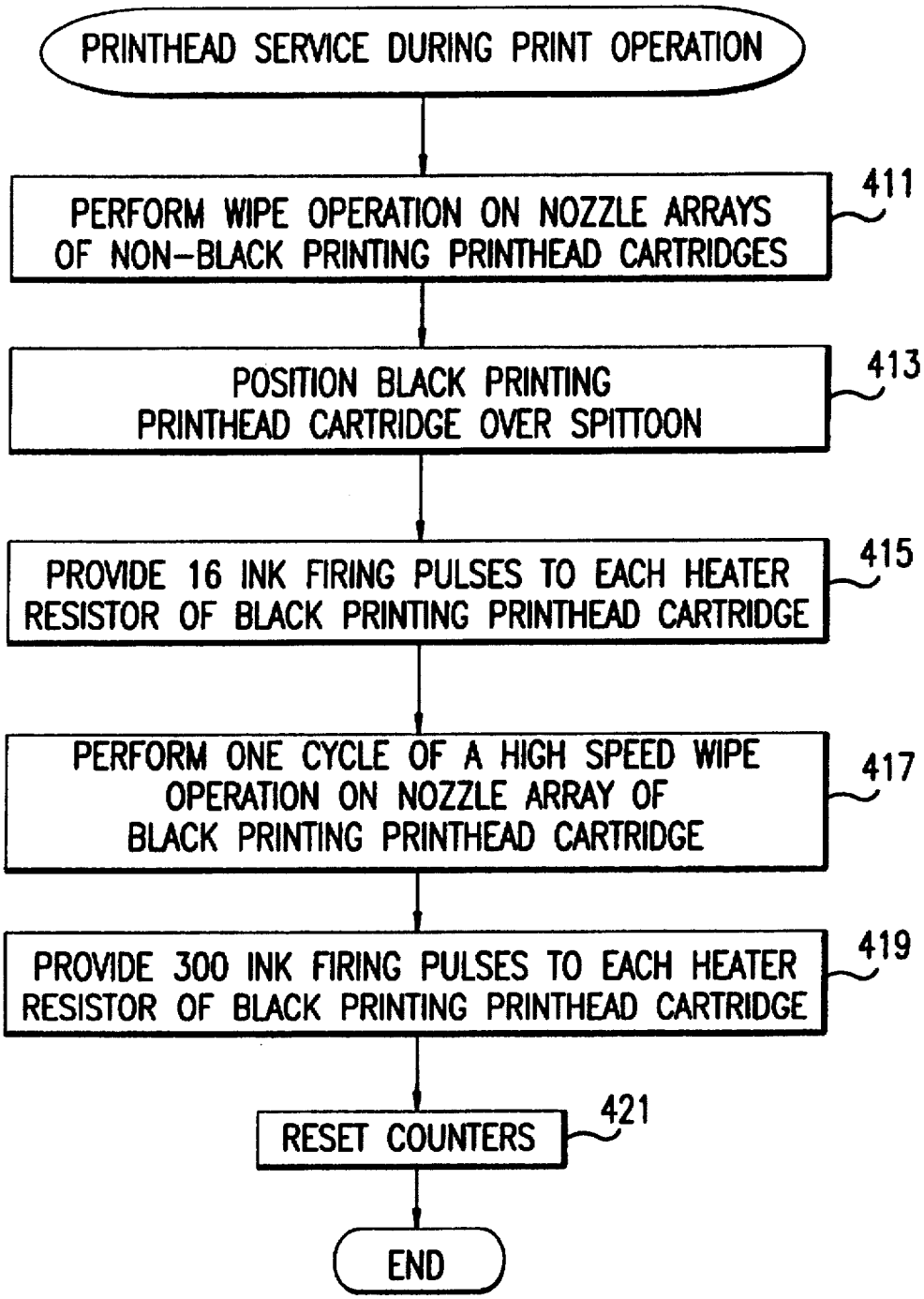
FIG. 16 is a flow diagram illustrating a print time printhead cartridge service of the printhead service procedure of FIGS. 13A and 13B.
Figure 17:
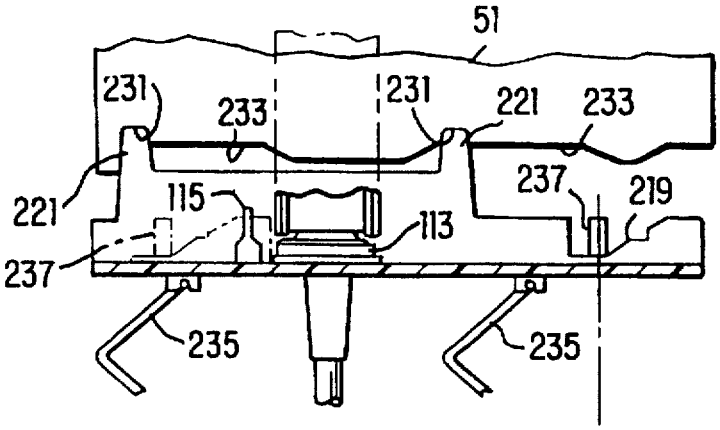
FIG. 17 is a schematic elevational view illustrating the sled of the printer of FIG. 1 in a capping position with printhead nozzle arrays capped by caps on the sled.
Figure 18:
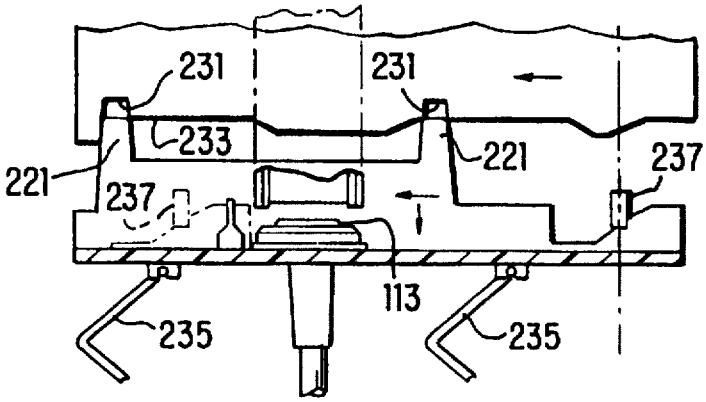
FIG. 18 is a schematic elevational view illustrating the sled of the printer of FIG. 1 as it is moved from the capping position by movement away from the capping location of the carriage that supports the printhead nozzle arrays.
Figure 19:
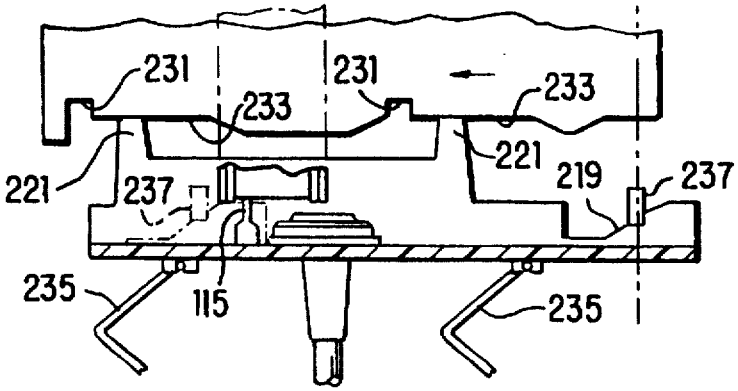
FIG. 19 is a schematic elevational view illustrating the sled of the printer of FIG. 1 in a stationary wiping position wherein printhead nozzle arrays move against wipers on the sled as the carriage continues to move away from the capping location.
Figure 20:
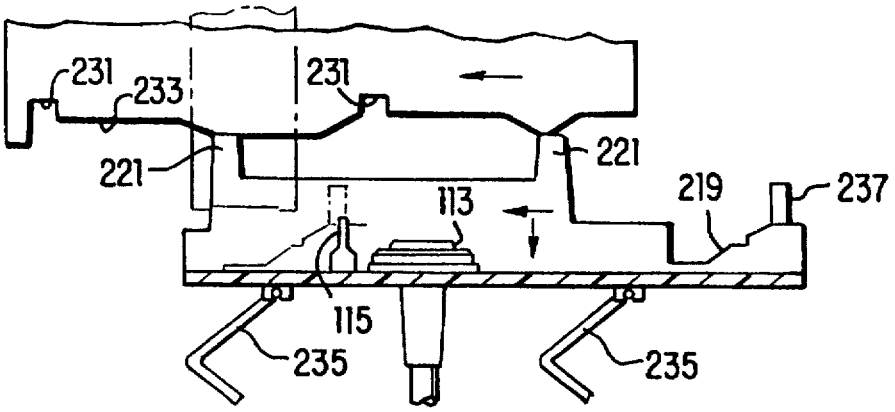
FIG. 20 is a schematic elevational view illustrating the sled of the printer of FIG. 1 as it is moved from the wiping position to the down position as the carriage continues to move away from the capping location after the printhead nozzle arrays have been wiped.
Figure 21:
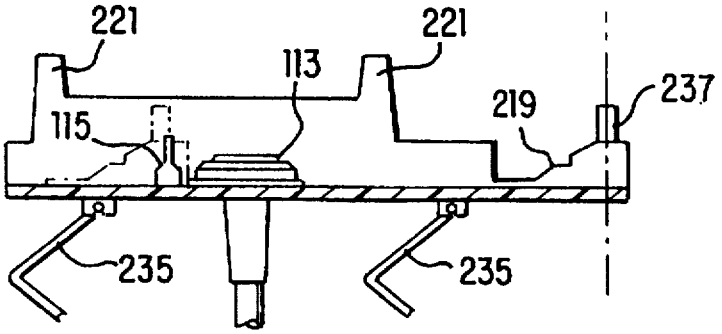
FIG. 21 is a schematic elevational view illustrating the sled of the printer of FIG. 1 in a stationary down position to which it has been moved pursuant to the continued movement of the carriage away from the capping location.
Figure 22:
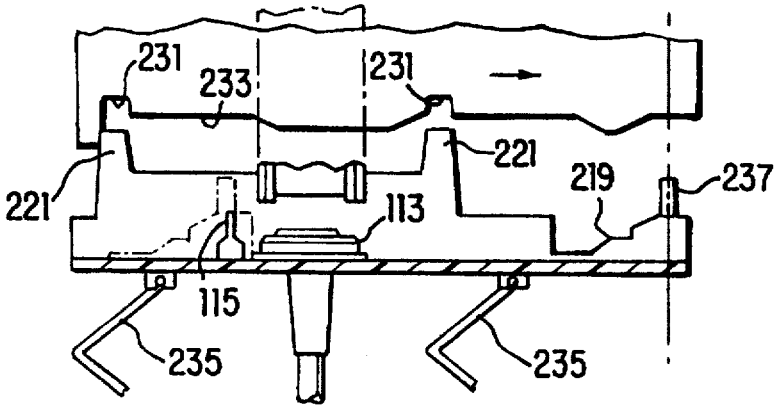
FIG. 22 is a schematic elevational view illustrating the sled of the printer of FIG. 1 as it is engaged by the carriage as the carriage moves toward the capping location.

If the determination at 327 is no, at 329 a determination is made as to whether the uncapped condition time count is greater than or equal to an uncapped condition time count threshold, such as 6 minutes. If yes, at 333 the print time printhead service of FIG. 16 is performed, and then control transfers to 321.

If the determination at 329 is no, at 331 a determination is made as to whether the drop count is greater than or equal to a drop count threshold, such as 50 million. If yes, at 333 and the print time printhead service of FIG. 16 is performed, and then control transfers to 321.

If the determination at 331 is no, control transfers to 321.

Figure 14:
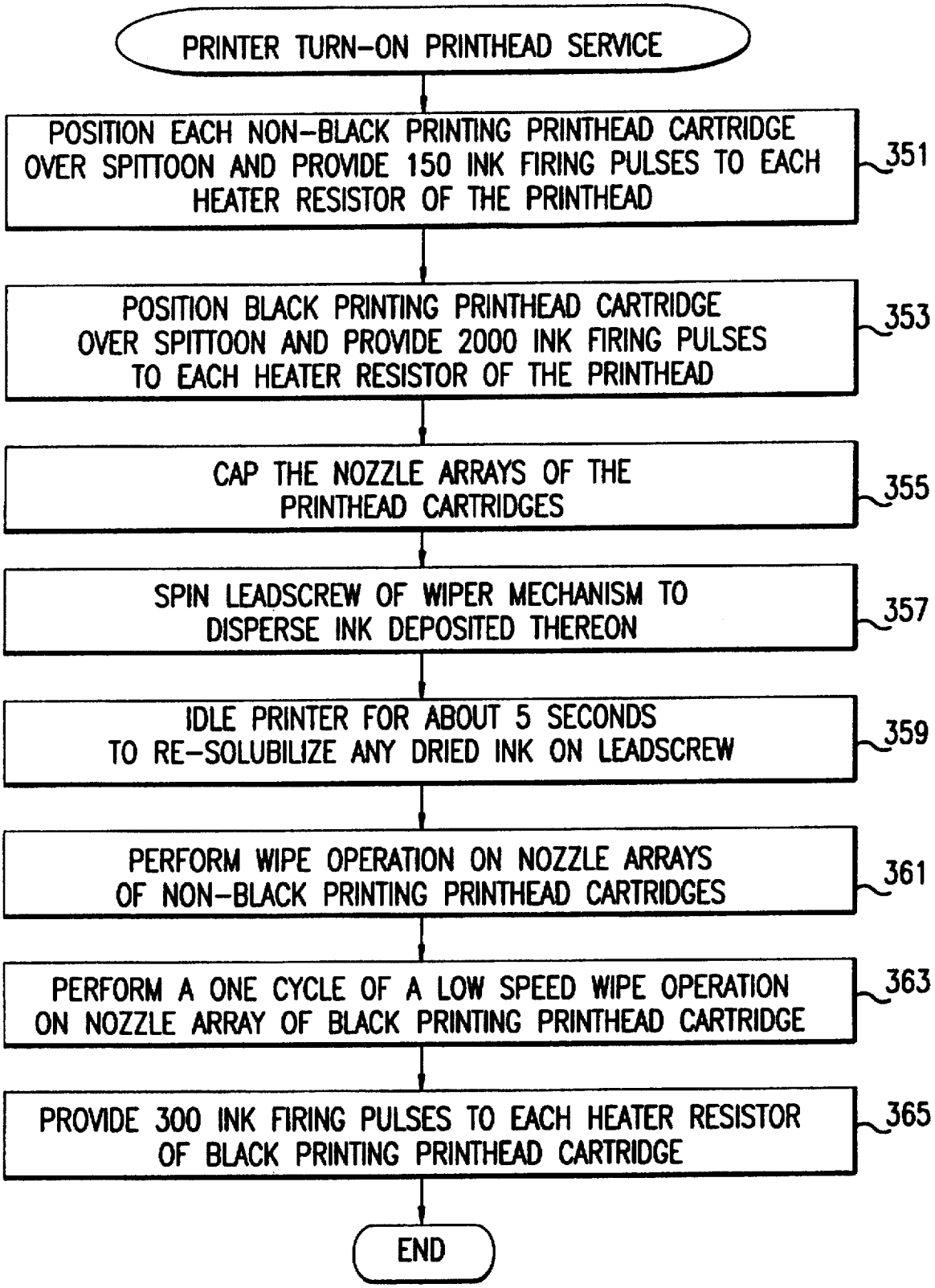
FIG. 14 is a flow diagram illustrating a printer turn-on printhead cartridge service of the printhead service procedure of FIGS. 13A and 13B.

Referring now to FIG. 14, set forth therein is a schematic flow diagram of a printer turn-on printhead service procedure that is performed when the printer is turned on. At 351 each of the non-black printing printhead cartridges is individually positioned over the spittoon, and about one hundred fifty (150) ink firing pulses are provided to each of the heater resistors of each printhead cartridge, whereby each non-black printing printhead cartridge performs a pre-wipe spitting operation which removes encrusted ink and dried ink plugs from the nozzles of the printhead cartridges, supplies fresh ink to the nozzles, and deposits ink on the wiper leadscrew of the second service station. At 353 the black printing printhead cartridge is positioned over the spittoon, and about two thousand (2000) ink firing pulses are provided to each of the heater resistors of the black printing printhead cartridge, whereby the black printing printhead cartridge performs a spitting operation which removes encrusted ink and dried ink plugs from the nozzles of the black printing printhead cartridge, supplies fresh ink to the nozzles thereof, and deposits ink on the wiper leadscrew of the second service station. At 355 the nozzle arrays of the printhead cartridges are capped by driving the carriage to the first service station. At 357 the media axis stepper motor is actuated to spin the wiper leadscrew of the second service station for about 2.5 seconds to disperse the fresh ink deposited thereon, and at 359 the printer is idled for about 5 seconds to allow any dried ink on the wiper leadscrew to re-solubilize. At 361 a wiping operation is performed on the nozzle arrays of the non-black printing printhead cartridges by driving the print carriage away from the first service station, which causes the nozzle arrays of the non-black printing printhead cartridges to slide against respective wipers 115 (FIG. 2). At 363 the black printing printhead cartridge is positioned over the second service station and one cycle of a low speed wipe operation is performed on the nozzle array of the black printing printhead cartridge. In particular, the second service station is actuated to move the wiper blades across the nozzle array in a first direction that is parallel to the media advance axis, and then across the nozzle array in a second direction which is parallel to the media advance axis and opposite the first direction. A single cycle of a wipe operation includes a wipe in the first direction and a wipe in the second direction. By way of illustrative example, in the slow speed wipe operation the wipe speed is about 1.2 inches per second. At 365 about three hundred (300) ink firing pulses are applied to each of the ink firing resistors of the black printing printhead cartridge such that the black printing printhead cartridge performs a post-wipe spitting operation which clears from the nozzles any debris or contamination which may have been introduced into the nozzles by the wipe operation. The printer turn-on printhead service then ends.

Referring now to FIG. 15, set forth therein is a schematic flow diagram of a post-prime printhead service procedure that is performed when the printer detects that the printer access door has been open for more than a predetermined amount of time, indicating that a printhead cartridge may have been primed. At 371 a wiping operation is performed on the nozzle arrays of the non-black printing printhead cartridges, for example by driving the carriage to the first service station to cap the nozzle arrays of the printhead cartridges, and then driving the print carriage away from the first service station which causes the nozzle arrays of the non-black printing printhead cartridges to slide against respective wipers. At 373 the black printing printhead cartridge is positioned over the spittoon, and at 375 about three-hundred (300) ink firing pulses are applied to each of the ink firing resistors of the black printing printhead cartridge such that the black printing printhead cartridge performs a pre-wipe spitting operation which removes encrusted ink and dried ink plugs from the nozzles of the black printing printhead cartridge and supplies fresh ink to the nozzles thereof. At 377 two cycles of the low speed wipe operation described above relative to the printer turn-on printhead service procedure are performed. At 379 about nine-hundred (900) ink firing pulses are applied to each of the ink firing resistors of the black printing printhead cartridge such that the black printing printhead cartridge performs a post-wipe spitting operation which clears from the nozzles any debris or contamination which may have been introduced into the nozzles by the wipe operation. At 381 the page counter, the upcapped condition time counter, and the drop counter are reset to 0, and the post-prime printhead service procedure then ends.

Referring now to FIG. 16, set forth therein is a schematic flow diagram of a print time printhead service procedure that is performed during printing when the printer detects the conditions described above relative to the procedure of FIGS. 13A and 13B. At 411 a wiping operation is performed on the nozzle arrays of the non-black printing printhead cartridges, for example by driving the carriage to the first service station to cap the nozzle arrays of the printhead cartridges, and then driving the print carriage away from the first service station which causes the nozzle arrays of the non-black printing printhead cartridges to slide against respective wipers. At 413 the black printing printhead cartridge is positioned over the spittoon, and at 415 about sixteen (16) ink firing pulses are applied to each of the ink firing resistors of the black printing printhead cartridge such that the black printing printhead cartridge performs a spitting operation which removes encrusted ink and dried ink plugs from the nozzles of the black printing printhead cartridge and supplies fresh ink to the nozzles thereof. At 417 one cycle of a high speed wipe operation is performed, wherein the second service station is actuated to move the wiper blades across the nozzle array in a first direction that is parallel to the media advance axis, and then across the nozzle array in a second direction which is parallel to the media advance axis and opposite the first direction. A single cycle of a wipe operation includes a wipe in the first direction and a wipe in the second direction. By way of illustrative example, in the high speed wipe operation the wipe speed is about 2.3 inches per second. At 419 about three-hundred (300) ink firing pulses are applied to each of the ink firing resistors of the black printing printhead cartridge such that the black printing printhead cartridge performs a post-wipe spitting operation which clears from the nozzles any debris or contamination which may have been introduced into the nozzles by the wipe operation. At 421 the page counter, the upcapped condition time counter, and the drop counter are reset to 0, and the print time printhead service then ends.

Referring now to FIGS. 17–22, the sled 111 of the first service station 10 and the carriage 51 cooperate as follows to cap the nozzle arrays of the printhead cartridges and to wipe the nozzle arrays of the non-black printing printhead cartridges when the carriage moves away from engagement of the sled in the capped position. As shown in FIG. 15, when the sled is in the capping position, it is in its vertically highest position such that the caps 113 are in engagement with the printhead nozzle arrays that are overlying the caps as a result of movement of the carriage to the right to position the sled in the capping position. In the capping position, the prongs 221 of the sled are engaged in slots 231 of the carriage, and the lowest portion of the cam surfaces 219 are engaged against the stationary pegs 237 pursuant to the upward bias of the sled by the springs 235. As the carriage is moved to the left toward the center of the printer, the sled is moved to the left by virtue of the prongs 221 being contained in the slots 231 of the carriage. As the sled is moved to the left, it is vertically lowered away from the printhead cartridges as sloped portions of the cam surfaces 219 slide across the stationary pegs 237. Notches in the cam surfaces eventually engage the stationary pegs, at which time the sled prongs 221 are clear of slots 231 in the carriage 51. As the carriage continues its movement to the left, the prongs 221 remain clear of the cam surfaces 233 of the carriage 51, and sled remains stationary while the nozzle arrays of the non-black printing printhead cartridges slide over the resilient wipers 115. Continued movement of the carriage causes bumps in the cam surfaces 233 of the carriage 51 to engage the prongs 221 which causes the sled to move downward and to the left as the notches in the sled cam surfaces 219 disengage from the stationary pegs 237 sloped portions of the sled cam surfaces slide against the stationary pegs. The downward and to the left movement of the sled continues until horizontal portions of the sled cam surfaces become engaged with the stationary pegs 237 at which time the prongs 221 are clear of the bumps in the carriage cam surfaces 233. The sled is then in its down position wherein the upper edges of the wipers are vertically lower than the printhead nozzle arrays.

The sled is moved to the capping position pursuant to engagement of the prongs 221 by the carriage slots 231 as the carriage moves to the right. Since the sled is in the down position, the printhead nozzle arrays remain higher than the wipers until the carriage slots engage the prongs 221, at which time the printhead nozzle arrays are positioned over the caps 113. Continued movement of the carriage to the right causes the sled to move up and to the right with the carriage as the sled cam surfaces 219 slide across the stationary pegs 237. Eventually, the caps come into engagement with the printhead nozzle arrays, with the alignment between the nozzle arrays and the caps being controlled by the relative positioning of the slots 231 of the carriage and the prongs 221 of the sled 111.

More specific information as to the operation of the sled 111 relative to the carriage 51 is more particularly described in commonly assigned U.S. application Ser. No. 08/056,327, filed Apr. 30, 1993, by Heinz Waschhauser and William Osborne for "SERVICE STATION HAVING REDUCED NOISE, INCREASED EASE OF ASSEMBLY AND VARIABLE WIPING CAPABILITY," which is incorporated herein by reference; and in commonly assigned U.S. application Ser. No. 07/949,197, filed Sep. 21, 1992, by William S. Osborne for "INK-JET PRINTHEAD CAPPING AND WIPING METHOD AND APPARATUS," which is also incorporated herein by reference.

The foregoing has been a disclosure of ink jet printhead cartridge maintenance procedures that provide different printhead service procedures for different printer conditions, and advantageously avoid excessive nozzle array wiping while maintaining print quality.

Although the foregoing has been a description and illustration of specific embodiments of the invention, various modifications and changes thereto can be made by persons skilled in the art without departing from the scope and spirit of the invention as defined by the following claims.

What is claimed is:

1. A method for operating an ink jet printer that includes a printhead cartridge having a nozzle plate that includes a plurality of nozzles arranged in first and second nozzle columns which are substantially aligned with a media advance axis that is orthogonal to a carriage scan axis, a service station for capping and uncapping the nozzle array of the printhead cartridge, and a print carriage for supporting the printhead carriage and being movable along the carriage scan axis, the method comprising:

(A) performing a printer turn-on printhead service on the printhead cartridges;

(B) resetting a page counter, an uncapped condition time counter, and an ink drop counter, wherein the page counter counts the number of pages printed, the uncapped condition time counter counts the amount of time that the printhead cartridge is in the uncapped condition, and the ink drop counter counts ink drops emitted by the printhead cartridge;

(C) printing a plurality of pages of print media;

(D) after a page is printed performing the following steps if the printhead was primed while the page was being printed:

(1) performing a post-prime printhead service on the printhead cartridge;

(2) resetting the page counter, the uncapped condition time counter, and the drop counter;

(E) after a page is printed performing the following steps if the printhead was not primed while the page was being printed and if (a) the ink jet printer has printed at least a predetermined number of pages since the page count counter was reset, (b) the printhead cartridge has been uncapped for at least a predetermined amount of time since the uncapped condition time counter was reset, or (c) the printhead cartridge has emitted at least a predetermined number of ink drops since the drop counter was reset:

(1) performing a print time printhead service;

and (2) resetting the page counter, the uncapped condition time counter, and the drop counter.

2. The method of claim 1 wherein the printer turn-on printhead service comprises the steps of:

(1) providing a first predetermined number of ink firing pulses to each of the heater resistors of the printhead cartridge;

(2) moving a wiper at a predetermined speed across the nozzle array of the printhead cartridge in a first direction that is parallel to the media advance axis;

(3) moving the wiper at the predetermined speed across the nozzle array of the printhead cartridge in a second direction that is parallel to the media advance axis and opposite the first direction; and (4) providing a second predetermined number of ink firing pulses to each of the heater resistors of the printhead cartridge.

3. The method of claim 2 wherein the second predetermined number of ink firing pulses is less than the first predetermined number of ink firing pulses.

4. The method of claim 1 wherein the print time printhead service comprises the steps of:

(1) providing a first predetermined number of ink firing pulses to each of the heater resistors of the printhead cartridge;

(2) moving a wiper at a predetermined speed across the nozzle array of the printhead cartridge in a first direction that is parallel to the media advance axis;

(3) moving the wiper at the predetermined speed across the nozzle array of the printhead cartridge in a second direction that is parallel to the media advance axis and opposite the first direction; and (5) providing a second predetermined number of ink firing pulses to each of the heater resistors of the printhead cartridge.

5. The method of claim 4 wherein the second predetermined number of ink firing pulses is greater than the first predetermined number of ink firing pulses.

6. The method of claim 1 wherein the post prime printhead service comprises the steps of:

(1) providing a first predetermined number of ink firing pulses to each of the heater resistors of the printhead cartridge;

(2) moving a wiper at a predetermined speed across the nozzle array of the printhead cartridge in a first direction that is parallel to the media advance axis;

(3) moving the wiper at the predetermined speed across the nozzle array of the printhead cartridge in a second direction that is parallel to the media advance axis and opposite the first direction;

(4) repeating steps (2) and (3); and (5) providing a second predetermined number of ink firing pulses to each of the heater resistors of the printhead cartridge.

7. The method of claim 6 wherein the second predetermined number of ink firing pulses is greater than the first predetermined number of ink firing pulses.

8. A method for operating an ink jet printer that includes a printhead cartridge having a nozzle plate that includes a plurality of nozzles arranged in first and second nozzle columns which are substantially aligned with a media advance axis that is orthogonal to a carriage scan axis, a service station for capping and uncapping the nozzle array of the printhead cartridge, and a print carriage for supporting the printhead cartridge and being movable along the carriage scan axis, the method comprising:

(A) providing a first predetermined number of ink firing pulses to each of the heater resistors of the printhead cartridge;

(B) moving a wiper at a first predetermined speed across the nozzle array of the printhead cartridge in a first direction that is parallel to the media advance axis;

(C) moving the wiper at the first predetermined speed across the nozzle array of the printhead cartridge in a second direction that is parallel to the media advance axis and opposite the first direction; and (D) providing a second predetermined number of ink firing pulses to each of the heater resistors of the printhead cartridge;

(E) resetting a page counter, an uncapped condition time counter, and an ink drop counter, wherein the page counter counts the number of pages printed, the uncapped condition time counter counts the amount of time that the printhead cartridge is in the uncapped condition, and the ink drop counter counts the number of ink drops emitted by the printhead cartridge;

(F) performing the following steps if (a) the ink jet printer has printed at least a predetermined number of pages since the page count counter was reset, (b) the printhead cartridge has been uncapped for at least a predetermined amount of time since the uncapped condition time counter was reset, or (c) the printhead cartridge has emitted at least a predetermined number of ink drops since the drop counter was reset:

(1) providing a third predetermined number of ink firing pulses to each of the heater resistors of the printhead cartridge;

(2) moving the wiper at a second predetermined speed across the nozzle array of the printhead cartridge in a first direction that is parallel to the media advance axis, the second predetermined speed being greater than the first predetermined speed;

(3) moving the wiper at the second predetermined speed across the nozzle array of the printhead cartridge in a second direction that is parallel to the media advance axis and opposite the first direction;

(4) providing a fourth predetermined number of ink firing pulses to each of the heater resistors of the printhead cartridge.

9. The method of claim 8 wherein the second predetermined number of ink firing pulses is less than the first predetermined number of ink firing pulses.

10. The method of claim 8 wherein the fourth predetermined number of ink firing pulses is greater than the third predetermined number of ink firing pulses.

11. A method for operating an ink jet printer that includes a printhead cartridge having a nozzle plate that includes a plurality of nozzles arranged in first and second nozzle columns which are substantially aligned with a media advance axis that is orthogonal to a carriage scan axis, a service station for capping and uncapping the nozzle array of the printhead cartridge, and a print carriage for supporting the printhead cartridge and being movable along the carriage scan axis, the method comprising:

(A) providing a first predetermined number of ink firing pulses to each of the heater resistors of the printhead cartridge;

(B) moving a wiper at a predetermined speed across the nozzle array of the printhead cartridge in a first direction that is parallel to the media advance axis;

(C) moving the wiper at the predetermined speed across the nozzle array of the printhead cartridge in a second direction that is parallel to the media advance axis and opposite the first direction; and (D) providing a second predetermined number of ink firing pulses to each of the heater resistors of the printhead cartridge;

(E) printing a plurality of pages of print media;

(F) after a page is printed performing the following steps if the printhead was primed while the page was being printed:

(1) providing a third predetermined number of ink firing pulses to each of the heater resistors of the printhead cartridge;

(2) moving the wiper at the predetermined speed across the nozzle array of the printhead cartridge in a first direction that is parallel to the media advance axis;

(3) moving the wiper at the predetermined speed across the nozzle array of the printhead cartridge in a second direction that is parallel to the media advance axis and opposite the first direction;

(4) repeating steps (2) and (3); and (5) providing a fourth predetermined number of ink firing pulses to each of the heater resistors of the printhead cartridge.

12. The method of claim 11 wherein the second predetermined number of ink firing pulses is less than the first predetermined number of ink firing pulses.

13. The method of claim 11 wherein the fourth predetermined number of ink firing pulses is greater than the third predetermined number of ink firing pulses.

14. A method for operating an ink jet printer that includes a printhead cartridge having a nozzle plate that includes a plurality of nozzles arranged in first and second nozzle columns which are substantially aligned with a media advance axis that is orthogonal to a carriage scan axis, a service station for capping and uncapping the nozzle array of the printhead cartridge, and a print carriage for supporting the printhead cartridge and being movable along the carriage scan axis, the method comprising:

(A) performing a printer turn-on printhead service on the printhead cartridges;

(B) resetting a page counter, an uncapped condition time counter, and an ink drop counter, wherein the page counter counts the number of pages printed, the uncapped condition time counter counts the amount of time that the printhead cartridge is in the uncapped condition, and the ink drop counter counts the number of ink drops emitted by the printhead cartridge;

(C) printing a plurality of pages of print media;

(D) after a page is printed performing the following steps if (a) the ink jet printer has printed at least a predetermined number of pages since the page count counter was reset, (b) the printhead cartridge has been uncapped for at least a predetermined amount of time since the uncapped condition time counter was reset, or (c) the printhead cartridge has emitted at least a predetermined number of ink drops since the drop counter was reset:

(1) performing a print time printhead service; and (2) resetting the page counter, the uncapped condition time counter, and the drop counter.

15. The method of claim 14 wherein the print time printhead service comprises the steps of:

(1) providing a first predetermined number of ink firing pulses to each of the heater resistors of the printhead cartridge;

(2) moving a wiper at a predetermined speed across the nozzle array of the printhead cartridge in a first direction that is parallel to the media advance axis;

(3) moving the wiper at the predetermined speed across the nozzle array of the printhead cartridge in a second direction that is parallel to the media advance axis and opposite the first direction; and (4) providing a second predetermined number of ink firing pulses to each of the heater resistors of the printhead cartridge.

16. The method of claim 15 wherein the second predetermined number of ink firing pulses is greater than the first predetermined number of ink firing pulses.

* * * * *